United States Patent [19]

Rhees et al.

[11] 4,038,170

[45] July 26, 1977

[54] ANODE CONTAINING LEAD DIOXIDE DEPOSIT AND PROCESS OF PRODUCTION

[76] Inventors: Raymond C. Rhees, 147 Ivy, Henderson, Nev. 89015; Bruce B. Halker, 657 6th St., Boulder City, Nev. 89005

[21] Appl. No.: 662,632

[22] Filed: Mar. 1, 1976

[51] Int. Cl.[2] ..... C25B 1/34; C25B 1/26; C25B 1/30; C25B 11/06

[52] U.S. Cl. ..... 204/290 R; 204/42; 204/57; 204/82; 204/95; 204/290 F; 429/228

[58] Field of Search ..... 204/290 R, 290 F, 293; 429/228

[56] References Cited

U.S. PATENT DOCUMENTS

| | | | |
|---|---|---|---|
| 1,851,219 | 3/1932 | Tainton | 204/293 X |
| 2,945,791 | 7/1960 | Gibson | 204/57 |
| 3,207,679 | 9/1965 | Schmidt | 204/42 |
| 3,213,004 | 10/1965 | Schmidt | 204/29 |
| 3,463,707 | 8/1969 | Gibson et al. | 204/15 |
| 3,632,497 | 1/1972 | Leduc | 204/263 |
| 3,755,112 | 8/1973 | Fountain et al. | 204/108 |
| 3,880,728 | 4/1975 | Habermann et al. | 204/38 A |

*Primary Examiner*—F.C. Edmundson
*Attorney, Agent, or Firm*—Pollock, Vande Sande & Priddy

[57] ABSTRACT

An anode comprising a substrate having a deposit of lead dioxide containing bismuth and process for preparing the anode.

9 Claims, 4 Drawing Figures

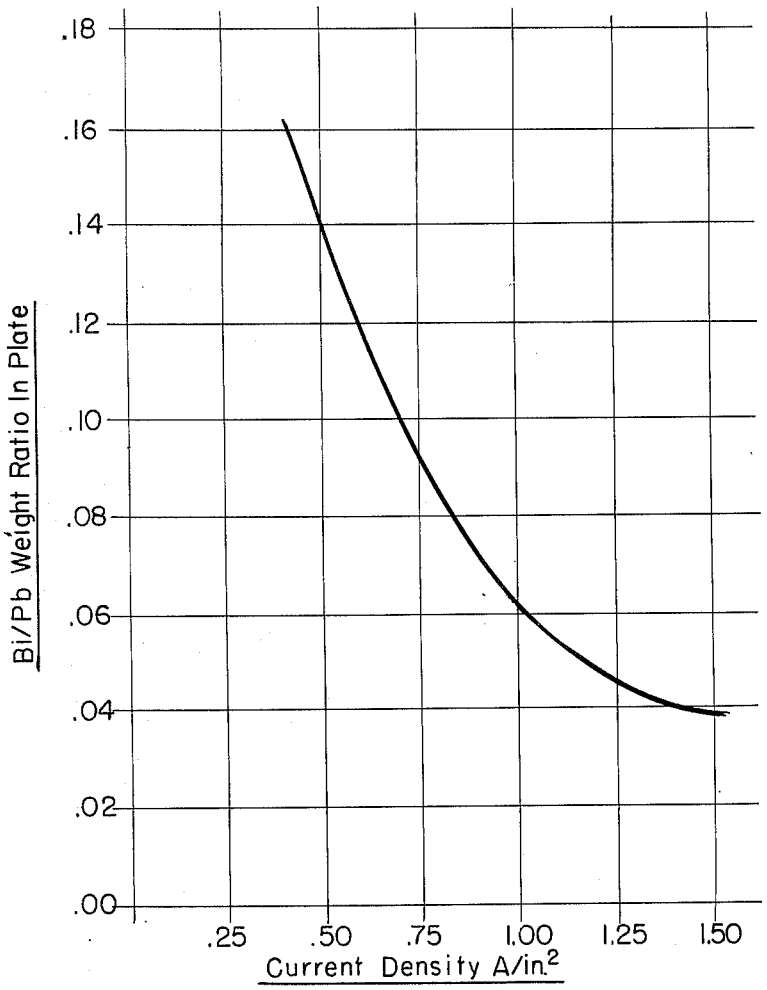
FIG. 1.
FIG. 2.
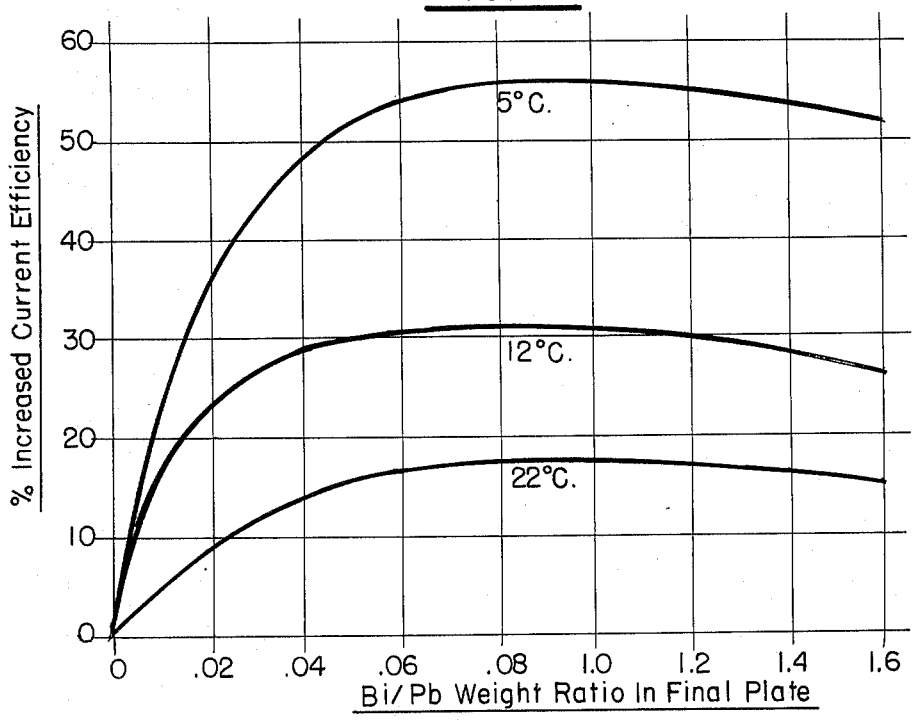

FIG. 3.
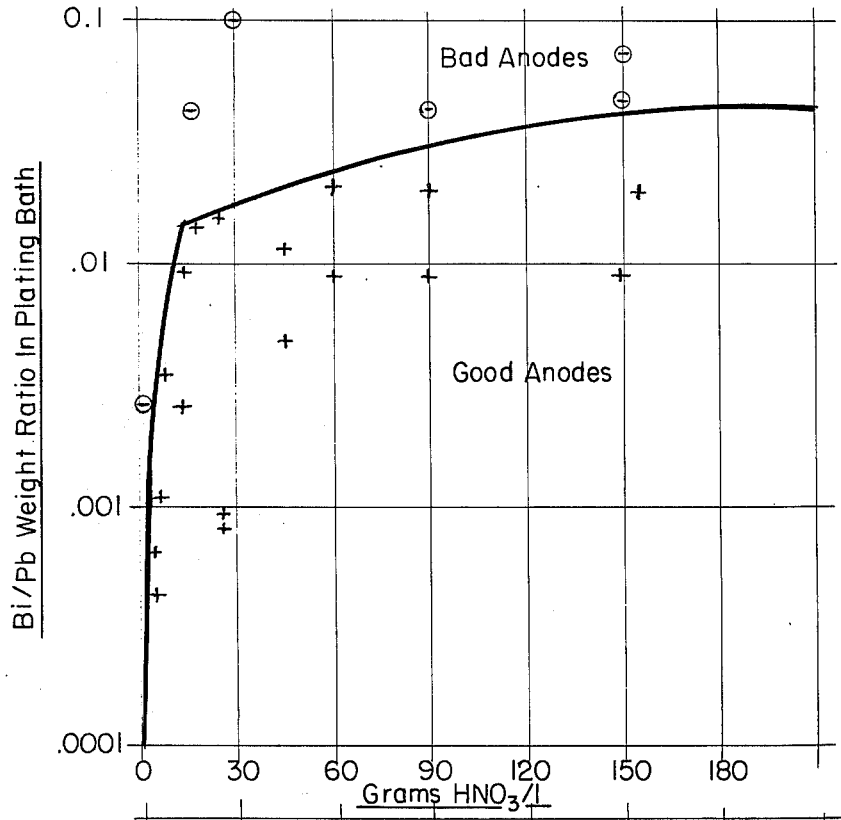
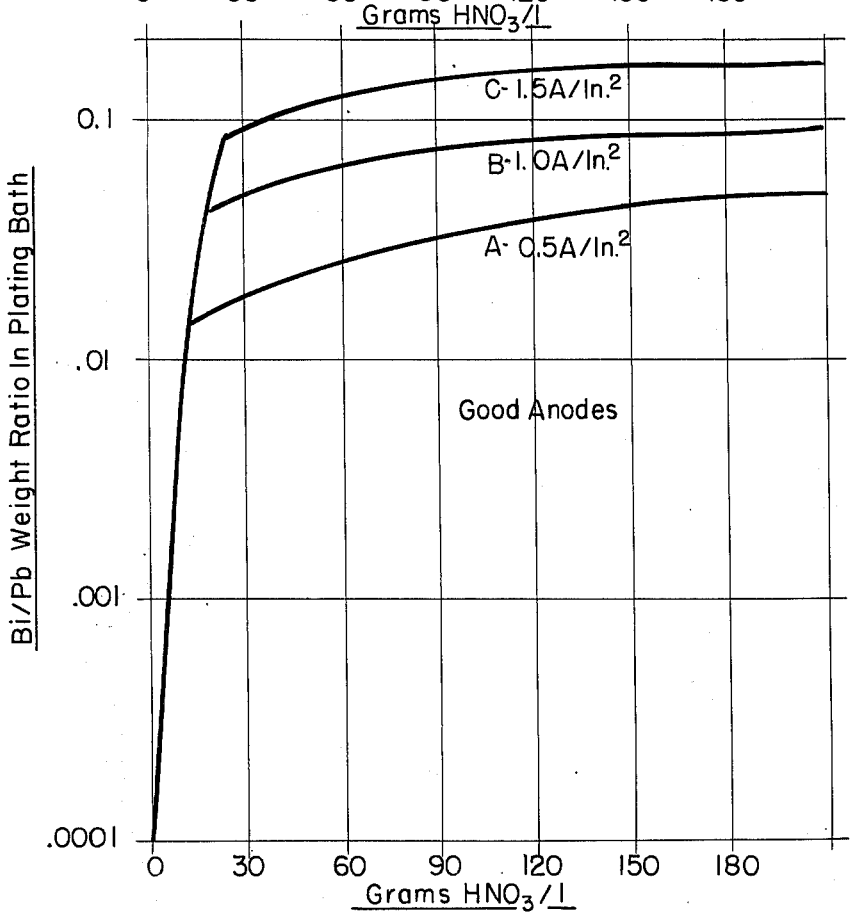
FIG. 4.

ANODE CONTAINING LEAD DIOXIDE DEPOSIT AND PROCESS OF PRODUCTION

BACKGROUND OF THE INVENTION

Lead dioxide, also known as anhydrous plumbic acid, lead peroxide and lead superoxide, is a very useful material. When provided in the form of a relatively thin coating upon the surface of an electrically conductive supporting base or substrate, it is useful as an electrode in corrosive electrolytes. For instance, a substrate coated with lead dioxide is useful as an anode in the electrolytic production of a wide variety of compounds exemplified by sodium chlorate; sodium perchlorae; alkali earth hypochlorites, chlorates and perchlorates; chlorine; sodium hypochlorite; sodium bromate, sodium iodate; sodium peridate; potassium chlorate and percholorate; iodic acid; periodic acid; potassium bromate; potassium iodate; and potassium peridate. Such anodes also find applications in chrome plating.

The electrodes are also useful in carrying out a large number of electro-oxidation reactions including destruction of phenol, cyanide, and ammonia in waste water; selective oxidation of organic compounds; on-site generation of disinfectants; preparation of oxidative solutions for odor control; and oxidation and extraction of various minerals from ores.

When it is desired to produce an anode comprising a coating of lead dioxide on a base substrate for use in an electrochemical cell, it is of great importance that the lead dioxide coating be tightly adherent to the substrate material, and that the coating be uniform, nonporous, and able to withstand a substantial amount of abuse. The various prior art processes have involved the electrodeposition of lead dioxide from a solution containing a lead salt. For the most part, these processes have developed anodes which are not suitable for electrochemical use as inert or insoluble anodes because they suffered from one or more of the following defects:

a. the lead dioxide deposit was not uniform and not sufficiently adherent to the electrode surface;

b. the lead dioxide coating was too porous and too coarse;

c. the lead dioxide deposit would not withstand the normal abuse associated with routine handling in a commercial plate; and d. the active life of the electrode was drastically shortened due to excessive plate corrosion, particularly above the solution level at the electrical buss connection. These defects, the consequent unreliability of the lead dioxie anodes, and the costiliness of the various expedients that have been proposed with the object of avoiding such defects, hampered their acceptance and compelled the use of platinum anodes. The latter, although more dependable, involve a very large original investment, suffer from platinum losses in processing, require a higher power input, and exhibit a lower efficiency than the anodes of this invention.

It was not until the advent of the process disclosed and claimed in U.S. Pat. No. 2,945,791, issued July 1960 to Fred D. Gibson, Jr., and assigned to the assignee of the present application, that the manufcture and use of lead dioxide anodes became entirely practical. That patent discloses a process for the electrodeposition of lead dioxide on a graphite substrate, and it is pointed out therein how the resultant lead dioxide coating is characterized by compactness and high density, hardness, smoothness, and a fine, randomly-oriented crystalline structure firmly bound to the graphite base. These characterizing features make it possible to use the resulting anodes in the electrolytic production of chlorine, chlorates, perchlorates, and other products without any further treatment. The completed anodes incorporate the mechanical strength of the graphite substrate, thereby overcoming many of the most trying difficulties which had previously been experienced. The making of an electrical connection to the anode is extremely simple, since contact can be made directly to the uncoated upper few inches of the graphite itself and need not be made to the lead dioxide coating. This process of making lead dioxide anodes and also the superior anodes resulting from such process have enjoyed considerable success, being quite widely used in various parts of the world.

Experience in using anodes prepared according to the process of U.S. Pat. No. 2,945,791 demonstrated that, although such anodes are superior to known lead dioxide anodes of the art prior thereto, anodes were nevertheless occasionally produced which did not have a coating which was tightly adherent over the entire surface. When this occurs, the corrosive electrolyte can attack the substrate during subsequent use, thereby progressively deteriorating the quality of the lead dioxide coating in that area. When such a condition is found to exist, it must of course be quickly remedied, and this requires the shutting down of the cell employing the defective anode and the replacement of such anode with a new one. This involves not only the cost of providing a new anode but also results in a decrease in production of the shutdown time of the cell. Accordingly, efforts were undertaken to increase anode life and thereby substantially reduce operating costs.

The electrolytes proposed in U.S. Pat. No. 2,945,791 and some of the art prior thereto, for deposition of lead dioxide generally included lead nitrate, copper nitrate, nickel nitrate, and nitric acid. U.S. Pat. No. 2,945,791 further suggested the incorporation in the electrolyte of small amounts of sodium fluoride and a surface-active agent. These various ingredients srved various purposes. For instance, it was considered important for the copper nitrate to be present to effect preferential plating of copper rather than lead on the cathodes of the cells in which the lead dioxide anodes were being prepared. While the copper does tend to build up deposites which would eventually short-circut the cells unless they were periodically shut down to remove such deposits, such shut-downs, though expensive, are still less objectionable than the consequences of permitting lead to deposit on the cathodes. The presence of the nickel nitrate was considered an important factor in the attainment of desirable fineness in the crystalline structure of the lead dioxide deposit. Experience in the manufacture of high purity lead dioxide, such as is required in the anodes intended for use in electrochemical production of chlorine, chlorates perchlorates and other compounds, has shown that the above-described electrolytes should have an acid concentration of less than about 8 grams per liter. Although lead dioxide will, to be sure, plate out in the presence of higher concentrations of acid, the resultant deposit generally has been decidedly inferior in quality. In actual practice, therefore, the acid concentration was limited to about 4 to 6 grams acid per liter of elecrolyte.

The continued research to produce improved lead dioxide anodes on the one hand and to reduce the cost of their production on the other hand led to the improved process disclosed in U.S. Pat. No. 3,463,707 and assignedto the assignee of the present application. The process of U.S. Pat. No. 3,463,707 made possible the production of improved electrodes while at the same time making possible the use of an electrolyte having fewer ingredients than therefore though necessary. Another benefit disclosed in U.S. Pat. No. 3,463,707 was the reducton in operating costs, since the more expensive ingredients of prior art electrolytes such as copper nitrate and nickel nitrate are not required in the process disclosed in U.S. Pat. No. 3,463,707. The improved results obtained by the process of U.S. Pat. No. 3,463,707 stem particularly from the use of an improved electrolyte. Broadly speaking the electrolyte of the invention of said U.S. Pat. No. 3,463,707 is one in which the acid concentration is maintained substantially above previously acceptable values in conjunction with limiting of the concentration of certain other constituents of the electrolyte to prescribed levels.

Although anodes produced according to the processes of U.S. Pat. No. 2,945,791 and 3,463,707 are superior to other lead dioxide anodes, occasionally anodes are produced which have imperfections in the lead dioxide coating and may not be as smooth as desired.

Accordingly, it is an object of the present invention to make possible the manufacture of lead dioxide anodes which are freer of imperfections as compared to prior art anodes.

In addition, since lead dioxide anodes lose lead by surface wear during electrolytic action during use, the ability to decreae surface wear would be a significant advantage. In particuiar, the loss of lead has been a problem when the anodes are used in cold electrolytes such as at temperatures of below about 15° C. Therefore, it is another object of the present invention to make possible the manufacture of lead dioxide anodes having improved resistance, to surface attack during electrolytic action, and particularly in rlatively cold electrolytes.

Another object of the present invention is to provide lead dioxide anodes which exhibit improved current efficiency in electrolytic processes.

It is a further object of this invention to provide for the production of lead dioxide anodes which are suitable for use as an insoluble anode in electrolytic processes using corrosive electrolytes and, in particular, for the production of sodium chlorate; sodium perchlorate; chlorine; alkali earth hypochlorites, chlorates, and perchlorates; sodium hypochlorite; sodium bromate, sodium iodate; sodium periodate; potassium chlorate and perchlorate; iodic acid, periodic acid; potassium salts of bromates, iodates, and periodates, and as an inert anode in chrome plating solutions. Also, it is an object of the present invention to provide anodes which are suitable for use in electrolyzing sea water to provide hyopchlorite.

Another object of the present invention is to provide a process for the production of bipolar anodes comprising flat sheets of substrate which are plated on only one side with a tightly adherent, smooth, nonporous coating containing lead dioxide.

SUMMARY OF THEINVENTION

A process aspect of the present invention is directed to electrodepositing a coating containing lead dioxide on a substrate anode, the electrolyte containing an aqueous solution of a lead compound in a concentration and of the type capable of depositing lead dioxide on the substrate anode, the improvement comprising including in said electrolyte during coating of the lead dioxide on the substrate anode, bismuth in an amount to provide a ratio of bismuth to lead in said electrolyte of at least about $1.10^3$ and being sufficient to increase the current efficiency of the anode and/or decrease lead loss from the anode in low temperature electrolytes.

The present invention is also directed to an anode comprising a substrate having a continuous adherent deposit of lead dioxide containing bismuth in an amount sufficient to provide a ratio of bismuth to lead in the deposit of at least about $1.10^2$ and being sufficient to increase the current efficiency of the anode and/or decrease lead loss from the anode in low temperature electrolytes, and said substrate having a composition different from the adherent deposit.

BRIEF DESCRIPTION OF THE DRAWINGS

FIG. 1 is a graph which illustrates the relationship between Bi/Pb weight ratio in plate and current density during plating.

FIG. 2 is a graph which illustrates the relationship between current efficiency in making sodium hypochlorite from salt brine and Bi/Pb ratio in final plate.

FIG. 3 is a graph illustrating the relationship between plating conditions and quality of anodes.

FIG. 4 is a graph which illustrates the relationship between plating conditions, current density, and qualiy of anodes.

DESCRIPTION OF PREFERRED EMBODIMENTS

The present invention is practiced by employing as the electrolyte, an aqueous acidic solution of a lead compound in a concentration and of a type capable of depositing lead dioxide on the substrate anode and bismuth. The bismuth is present in an amount sufficient to provide a ratio of bismuth to lead in the electrolyte of at least about $1:10^3$ and sufficient to increase the current efficiency and the stability of the anode during use in electrolytic processes. The preferred ratio of bismuth to lead in the electrolyte is between about 1:200 and about 1:40.

The improvement in the properties of the anode increases rapidly up to a bismuth/lead ratio in the plate of about 0.05 (1/20) and then more slowly up to a ratio of about 0.20 (1/5). At bismuth/lead ratios higher than about 0.20, it is preferred to employ relatively thin coatings, since the plate at such higher ratios has a tendency to crack somewhat. The use of thin coatings at such higher bismuth/lead ratios greatly reduces the possibility of cracking. It has been observed that the bismuth/-lead weight ratio in the plate is approximatey ten times that in the solution from which it is plated. It has been observed that the ratio in the plate is a linear function of the ratio in the electrolyte solution up to a bismuth/lead ratio in the plate of about 0.2. The preferred ratio of bismuth to lead in the final surface coating is in the range of about 0.05 (1/20) to about 0.12 (1/8).

The bismuth can be incorporated into the electrolyte solution by dissolution of metallic bismuth and/or in the form of a bismuth compound which is soluble in the electrolyte solution. Also when a bismuth compound is employed, it is preferred that such not introduce materials in the lead dixoide plate which would tend to adversely affect the properties of the plate to an undesired extent. Examples of some suitable bismuth compounds include bismuth chloride, bismuth ammonium citrate, bismuth fluoride, bismuth hydroxide, bismuth nitrate, bismuth oxychloride, bismuth pyrogallate, bismuth oxycarbonate, bismuth oxynitrate, bismuth salicylate, bismuth sulfate, bismuth sulfide, bismuth tannate, bismuth tartrate, bismuth tetraoxide, bismuth trioxide, and bismuth citrate.

The most preferred lead compound employed in the electrolyte solution is lead nitrate. Other lead compounds which can be employed include those which form nitrates on reactions with nitric acid such as metallic lead, lead oxides, and hydroxide and lead subnitrates. The lead is generally present in the solution in amounts between about 30 and about 380 g/l calculated as metallic lead.

The electrolyte solution contains an acid in an amount at least sufficient to solubilize the lead and bismuth in the electrolyte solution. The acid is generally employed in amounts from about 5 g/l to about 150 g/l. The acid employed should not cause formation of insoluble salts with the lead and bismuth. Examples of suitable acids include nitric acid, nitrous acid, and perchloric acid.

The electrolyte solution can include other constituents when desired such as the many known plating bath additives including copper nitrate, sodium fluoride, nickel nitrate, and surface-active agent such as those available under the trade designation Igepal from Antara Chemicals, a division of General Analine and Film Corporation. Igepal surfactants comprise several homologous series of alkylphenoxypoly (ethyleneoxy) ethanols. One surfactant of interest is Igepal CO-990 which is nonylphenoxypoly (ethyleneoxy) ethanol.

For example, if it is desired to use nickel nitrate, in order to produce an especially fine grain of lead dioxide coating, then nickel nitrate may be added with a concentration of about 10 grams per liter. When sodium fluoride is employed, it is preferably present in amounts from about 0.2 to 0.8 grams/liter, and most preferably about 0.5 g/liter.

In addition, impurities known in the art to be harmful such as iron should be controlled to those levels found acceptable. For instance, it is preferred to limit the concentration of iron, calculated as metallic iron, to a value in the range of 0 to about 0.02 g/l. It should be understood that a concentration of .02 g/l of iron does not constitute an upper limit for iron at which a substrate can satisfactorily be plated with lead dioxide but rather represents a control limit for production of lead dioxide coatings of consistently high quality. The amount of iron present is determined through the use of sulfosalicylic acid with a pH of 2.0 (colorimetric).

During the course of the electrodeposition process, it is desirable to replenish the lead and bismuth in the electrolyte and also to maintain the electrolyte at the proper acidity. This can be accomplished by feeding the effluent from the cell to a feed tank and thereafter adding lead and bismuth materials as required to maintain proper acidity and concentrations of lead and bismuth.

A continuous circuit can be provided so that the replenished electrolyte is continuously fed to the cell. The electrolyte is heated in the feed tank process for the preparation and control of the constituency of an electrolyte for use in the electrodeposition. Also, when desired, the process can be carried out without replenishing the lead and bismuth during plating by starting with a sufficiently high concentration of each and programming current densities during the plating sequence.

The anode substrates upon which the lead dioxide coatings can be electrodeposited include graphite and film-forming metals such as titanium, tantalum, zirconium, niobium, tungsten, hafnium, mixtures and alloys thereof. In addition, it may be desirable to employ as the substrate a film-forming metal such as titanium or the other metals described hereinabove, precoated with a metal-containing coating which is electroreactive (e.g. known to be advantageous in electrolytic applications). Examples of suitable metal-containing coatings are metals of the platinum group, oxides thereof, nitrides thereof or borides thereof.

Various types of materials may be used for the cathodes of the electrolytic cell for the electrodeposition of the lead dioxide-containing coatings. Examples of suitable materials for cathode include stainless steel, graphite, copper, and titanium. Preferably, a plurality of stainless steel rods of circular cross section is employed in order to give a high current density when lead dioxide anodes are being prepared. The rods are disposed at intervals about the surface of the anode being plated. Preferably, the total cathode area is such as to give a cathode current density which is about 1.5 to about three times the corresponding anode density. With respect to the electrode voltage employed, this may vary from about 1.9 volts to about 3.5 volts according to the magnitude of current desired.

We have discovered that the beneficial effects from inclusion of bismuth in the lead dioxide plate are related to the deposit at the surface of the anode. It is therefore not necessary to apply the entire bismuth modified $PbO_2$ plate to the substrate at the conditions required to obtain the effect of the proper bismuth concentration in the plate. This is of great advantage in that it permits the initial plate to be formed on the bare substrate under conditions most favorable to the formation of the best bond and electron transfer characteristics at this substrate-metal oxide coating interface and then permits varying the conditions of plating to permit formation of the most desirable bismuth-lead-peroxide structure at the external plated surface.

The effect of current density on the Bi/Pb ratio in the final plate is shown in FIG. 1 for plate produced in a plating bath having a Bi/Pb weight ratio = 0.01, 30 g $HNO_3$/l and 80° C. This very marked effect of increasing the Bi/Pb weight ratio in the plate by reducing the current density indicates that bismuth tends to plate preferentially. This result was unexpected and makes possible sequential variation of plating conditions favorable to production of a superior anode. In particular, the substrate can be preplated from a plating bath using conditions known to give a good substrate - $PbO_2$ bond such as taught in U.S. Pat. Nos. 2,945,791 and 3,463,707. The bismuth modified plate can then be applied from a bath of suitable composition first using a high current density followed by either continuous or stepwise reduction of the current density giving a plate on the substrate varying from zero bismuth at the substrate interface to the upper limit desired. This avoids any sharp discontinuities in the composition of the plate which may give rise to flaking of the outside plate from that adjacent to the substrate.

This does not mean that inclusion of bismuth in the metal oxide plate at the substrate interface produces an undesirable anode. However, the amount of bismuth which can be readily included at that interface is limited somewhat by the desirably low acid concentration in the plating bath during initial coverage of the substrate for best metal oxide-substrate adherence. After the preplate has been applied, however, very high acid concentrations in the plating bath can be used greatly increasing the solubility of bismuth in the plating bath and permitting applying the final plate from solutions much higher in Bi/Pb ratio.

An improved bismuth modified anode may be plated from a single electrolytic bath by holding the nitric acid concentration level within the range to produce a good substrate-metal oxide bond (2–25 g/l) using a bismuth concentration just less than saturation level in the solution; initiating the plating at high current density and lowering the current density as plating progresses to gradually increase the Bi/Pb ratio in the plate.

It should be noted that there is no limit implied as to the number of bismuth containing lead dioxide coats which may be applied. It has been found advantageous in some applications to apply multiple coats either from the same bath or from baths of different composition to eliminate imperfections in the plate which penetrate to the substrate.

The current density, bath composition, and temperature conditions for the second and successive coatings should be those to produce a coating having bismuth to lead weight ratio between about 1/100 and 1/5 and preferably between about 1/20 and 1/8. The plating time for successive coats should be such as to produce the desired overall thickness of the plate (e.g., about 0.01 to about 0.5 inches).

Graphite and various metals such as titanium, tantalum, zirconium, hafnium, niobium, and tungsten can be employed as the substrate employing methods of preparation before plating which are known in the art. For instance, when the substrate is graphite, it can first be planed by an electric planar to remove approximately one-sixteenth inch of graphite from the faces of the substrate.

In plating anodes upon the substrate matrials comprising titanium, tantalum, zirconium, hafnium, niobium or tungsten, a different treatment is employed than when graphite is used for the substrate. Whereas the graphite has a relatively coarse surface, with rough irregularly shaped edges to which a lead dioxide plating can quite readily adhere, the above-mentioned metals tend to have a much smoother surface, and it has been found that this surface should be treated to give it a substantially jagged and uneven surface having both rough depressions and jagged protruding surfaces. This can be accomplished by subjecting the surface to sandblasting since it has been found that this treatment tends to produce rough, irregular craters in the surface of the substrate, thereby greatly enhancing the adherence of the lead dioxide to the plate.

When it is desired to plate lead dioxide on a relatively thin plate of titanium, tantalum, zirconium, hafnium, and niobium, it is found that there is a natural tendency of the lead dioxide coating to curl and thereby bend the sheet. Although this tendency of the coating to curl presents no problem when plating onto a circular anode, it does present problems when plating a flat sheet since, not only is there a bending of the sheet, which is a serious disadvantage when using the anode in a cell, but also stresses are produced in the coating because of its inherent tendency to curve so that there is a lack of adherence of the coating, particularly in the central portion of the plate.

To overcome this, the plated area of the sheet can be divided into a number of discrete areas, so that the stress which may be produced in any one elemental area will not be transmitted to the next. This is accomplished by anodizing the entire surface of the sheet and then removing the anodized coating in all areas where it is desired to subsequently plate the lead dioxide. Removal of the anodization may be carried out by sand blasting the sheet.

Anodization of the sheet may be carried out in any of numerous ways, since any method may be used that electrically passivates the metal.

A similar method may be used to manufacture a bipolar lead dioxide coated anode. Thus, the metal sheet forming the substrate is first anodized on both surfaces as indicated above. Upon completion of anodization, that side of the sheet which is to form the anode has elemental areas thereof sand blasted so as to remove the anodizing, thereby conditioning the substrate for the coating of lead dioxide thereon. The opposite side of the sheet, which is to serve as a cathode, retains the anodized coating so that when the sheet is immersed in the plating cell, no lead dioxide will plate onto that side of the sheet. When the plating process is complete, the anode side of the substrate will have a plurality of relatively small areas thereon each coated with a coating of lead dioxide, whereas the other side of the sheet will have no lead dioxide plated thereon but will instead have only an anodized surface. Other known methods of pretreatment of the substrates can, of course, be employed when desired.

In plating lead dioxide onto any of the substrates referred to above, satisfactory coatings have been obtained with a thickness of about 0.01 inch to about 0.5 inch, but a coating of about 0.02 to 0.2 inch is preferred. By proceeding as outlined above, a lead dioxide deposit is produced having the characteristics of a fine crystalline, randomly-oriented structure, having a hard smooth surface, high tensile strength and strong adherence to the substrate.

The following examples are provided to further illustrate the present invention.

EXAMPLE 1

Two solutions are made having the following compositions:

| Preplate | gm/l |
|---|---|
| $Pb(NO_3)_2$ | 375 |
| $HNO_3$ | 5 |
| $Cu(NO_3)_2$ | 14 |
| Igepal CO-990 | 0.5 |
| Bi-Containing Plate | |
| $Pb(NO_3)_2$ | 375 |
| $HNO_3$ | 21 |
| $Bi(NO_3)_3 \cdot 5H_2O$ | 40 |
| $Cu(NO_3)_2$ | 14 |
| Igepal CO-990 | 0.5 |

Each plating solution is placed in separate four liter beakers. An anode-cathode bundle wherein the anode-cathode spacing is about 2 inches is provided employing a cathode consisting of a vertical stainless steel rod cylindrical basket surrounding an anode of a ½ inch diameter by 12 inches long nose rounded, surface sanded graphite rod. The anode-cathode bundle is inserted into the beaker containing the preplate bath so that the anode is immersed 6 inches into the plating solution. The DC power is connected to the anode and cathode. The temperature of the bath is held at about 79° C. Current is applied for 15 minutes (150 ampere minutes).

The anode-cathode bundle is then placed in the bismuth plating bath and the DC power is applied for 15 minutes to give a final plate approximately 0.18 mm in thickness (total metal oxide plate = 0.36 mm).

The plated portion of the anode is very smooth with a ceramic appearance.

A lead dioxide anode (no bismuth) is prepared having the same dimensions as the bismuth modified anode in accordance with the method disclosed in U.S. Pat. No. 3,463,707 to be used as the control in identical tests.

The anodes are mounted in standard laboratory cells. The cathode is a 1 inch I.D. 304 stainless steel pipe. Plastic PVC caps provided with inlet and outlet means are screwed on each end of the stainless steel cathode. The top cap is open at the top. The anode is positioned in a sealing ring and the anode and ring are inserted through the top PVC cap to nest and seal the anode in the stainless steel cathode. The nominal anode-cathode spacing is 3/16 inches.

The electrolyte for the comparison tests in prepared from reagent grade salt (NaCl) dissolved in distilled water to give a NaCl concentration of 30 g/l.

The electrolyte is circulated through the cell using a tubing pump from a beaker containing the electrolyte through the cell and back to the beaker. The temperature is controlled by circulating chilled water through a cooling coil in the beaker containing the electrolyte solution.

Power to operate the cells is supplied by a rectifier (AC input 110 volts, 20 amperes, single phase, DC output 100 amperes, 12 volts).

The cells are preconditioned before making the comparative tests.

The bismuth modified anode produces about 12% more sodium hypochlorite than the $PbO_2$ anode after 0.19 faradays of current is passed through each cell at 24° C.

The bismuth modified anode is then used extensively in various applications including hypochlorite production in prepared brine and in seawater, cathode scaling investigations, destruction of phenol, cyanide, ammonia, and sulfide in waste water from an industrial plant, and direct oxidative extraction of minerals from ore concentrates.

After five months the anode is again comparatively checked for producing hypochlorite in brine solution as previously described. This time at lower temperatures. The bismuth modified anode produced about 12.5% more sodium hypochlorite than the $PbO_2$ anode after 0.19 faradays of current is passed through each cell at 12° C.

Lead losses are also determined of the two anodes in comparative tests. The lead dioxide anode lost 11 times the amount of lead lost by the bismuth modified lead dioxide anode (at 12° C).

EXAMPLE 2

The two plating solutions used in Example 1 are adjusted to the compositions given and the same plating sequence except that a $\frac{1}{8} \times \frac{1}{2}'' \times 12'$ titanium strip is used as the substrate and is plated to a length of 4.5 inches using a modified cathode. The anode current density during preplate is reduced to 0.5 A/in.$^2$. The thickness of the bismuth modified plate is calculated to be 0.18 mm with an overall thickness of plate of 0.27 mm.

An excellent ceramic appearing plate is produced.

This anode is operated for two weeks in an electrolyte containing 150 g $H_2SO_4$ per liter at 2.5 volts (current density 1 amp/in.$^2$) without any visible or operational observed changes in the anode.

EXAMPLE 3

A solution having the following composition is prepared.

| | g/l |
|---|---|
| $Pb(NO_3)_2$ | 169 |
| $HNO_3$ | 5.8 |
| $Cu(NO_3)_2$ | 17.5 |
| KaF | 0.3 |
| Bi | 0.16 |

Plating is carried out using a shaped graphite anode in the plating cell and bath described in Example 1. High agitation is used during plating and the temperature is controlled to 76–80° C. The anode current density is sequentially varied as follows.

1 amp/in.$^2$ for 5 min.

0.5 amp/in.$^2$ for 62 min.

0.25 amp/in.$^2$ for 60 min.

The final anode plated diameter is 0.551 inches with a calculated plate thickness of 0.67 mm. The plate is very smooth and has the bismuth modified $PbO_2$ appearance.

The anode is mounted in a test cell as described in Example 1. A brine solution initially containing 250 grams NaCl/l is circulated through the test cell continuously for a total of 77 days adjusting only solution volume and pH during that time. The final solution contains 18 g NaCl/l and 430 g $NaClO_3$/l. The sodium chlorate is produced at an overall current efficiency of 87%. Lead loss during the test is 1/3 that of a similarly tested $PbO_2$ anode without bismuth.

EXAMPLE 4

Several test sets of large flat $1\frac{1}{2}$ inches × $6\frac{1}{4}$ inches × × 30 inches graphite substrate anodes are prepared in the plating plant and tested in the production circuit for electrolytic conversion of sodium chlorate to sodium perchlorate. The composition of the plating baths used vary over the following composition ranges.

| | g/l |
|---|---|
| $Pb(NO_3)_2$ | 173 – 208 |
| $HNO_3$ | 1.6 – 8.2 |
| Bi | 0.02 – 0.16 |
| $Cu(NO_3)_2$ | 7.5 – 10.5 |
| NaF | 0.24 – 0.69 |

The bismuth is added to the plating bath in all sets as a concentrated bismuth nitrate-nitric acid solution. The concentration level is achieved in one of three ways: (1) by addition to the electrolyte at the start of the plating operation; (2) by addition of predetermined quantities at predetermined times during the plating cycle; and (3) by addition of the concentrated $Bi(NO_2)_3$ solution continuously to the plating circuit during application of the bismuth modified lead dioxide coating.

The anodes prepared from electrolyte containing bismuth exhibit the characteristic sheen of bismuth modified anodes.

The anodes are coded for identification purposes and then used interchangeably with lead dioxide anodes containing no bismuth.

Their performance is normal in the electrochemical conversion of sodium chlorate to sodium perchlorate.

EXAMPLE 5

A bismuth modified $PbO_2$ anode is prepared by electroplating the Bi-Pb peroxides on the external surface of a titanium tube (1" tubing-16 in.$^2$ of plated area). This anode is inserted into 1¾ inches 304 stainless steel tubing to form an enclosed cell through which a NaCl (salt) brine solution is passed between the titanium substrate-bismuth modified anode and the stainless steel cathode. The anodecathode spacing is 5/16 inch.

A series of tests are made with this cell at various salt (NaCl) concentrations in the electrolyte. The cell is operated with the electrolyte fed to cell in both the continuous one-pass mode and the recycle mode. Sodium hypochlorite production and current efficiencies are excellent with sodium hypochlorite concentrations as high as 24 g/l at 61% current efficiency being achieved.

EXAMPLE 6

A test set of thirty large 1¼ inches × 6¼ inches × 30" shaped graphite anodes are plated in the anode plant from an electrolyte bath of the following composition

| | g/l |
|---|---|
| $Pb(NO_3)_2$ | 199 |
| $Cu(NO_3)_2$ | 8.5 |
| $HNO_3$ | 3.3 |
| NaF | 0.46 |
| Bi (start) | 0.141 |
| Bi (end) | 0.115 |

The plating sequence is as follows.

One hour at a current density of 0.73 A/in.$^2$

Three hours at a current density of 0.46 A/in.$^2$

Three hours at a current density of 0.21 A/in.$^2$

One-half hour at a current density of 0.61 A/in.$^2$

The bismuth/lead ratio in the bath is 0.0011 at the start of the plating cycle and 0.0009 at the end. The calculated bismuth/lead ratio in the plate is 0.0025. Much of the bismuth is deposited at the lower current density so that the Bi/Pb ratio in the deposited plate during that period is about 0.01. The plate thickness is 2 mm.

Two anodes from the set are used for pilot plant tests.

The anodes are mounted in a cathode made of 304 stainless steel of 1-15/16 × 7-3/8' in cross section and 40 inches deep. The assembled cell is mounted on an operating stand and connected to a source of DC power. Electrolyte containing 18 grams NaCl/l is recirculated through the cell at the rate of 3 gal/min. Temperature is controlled by inclusion of a water cooled heat exchanger in the recycle circuit.

Comparative tests are made using the bismuth modified lead dioxide anode and a lead dioxide anode plated with no bismuth addition. The bismuth modified anode produced 5 g/l sodium hypochlorite at 11% greater current efficiency operating on 15° C brine. However, no significant difference in current efficiency is observed at 30° C or above.

While the small amount of bismuth in this bismuth modified $PbO_2$ anode is insufficient to greatly influence current efficiency in producing sodium hypochlorite, lead losses are markedly reduced at low temperature by the bismuth modification.

EXAMPLE 7

Seventeen graphite substrate lead dioxide anodes are made as described in Example 1. The preplate solution has the following composition.

| | g/l |
|---|---|
| $Pb(NO_3)_2$ | 279–325 |
| Bi | 0 |
| $HNO_3$ | 3.2–7.9 |
| $Cu(NO_3)_2$ | 11.6–19.1 |

Current is applied to pass 0.108 Faradays during application of the preplate.

Each anode is then given a bismuth modified lead dioxide coating by applying another 0.108 Faradays under varying ratios of bismuth to lead in the bath; various nitric acid concentrations and various current densities as given in Table I.

The anodes are carefully examined. In each case the anode shows the characteristic effects of the bismuth modification which is a smooth, dense, fine grained deposit. The deposit strongly adheres to the substrate. The anode appears to be good to excellent with the exceptions noted in the Table. In the noted exceptions the plate cracked either during plating or after removal from the plating bath.

The anode is sectioned and representative portions are treated with nitric acid and hydrogen peroxide to dissolve the lead and bismuth materials. The ratio of bismuth to lead is then determined in the filtered solutions with the results shown in Table II. It is noted that the anodes which cracked in every case had weight ratios approaching 1 part bismuth to 5 parts lead (0.2).

TABLE I

| Bi/Pb in Solution | $HNO_3$ conc. g/l | Current Density A/in.$^2$ | Bi/Pb Plate | Quality |
|---|---|---|---|---|
| 0.011 | 30.3 | 1→0.5 | 0.100 | Excellent |
| 0.012 | 45.0 | 1→0.5 | 0.104 | Excellent |
| 0.010 | 59.5 | 1→0.5 | 0.083 | Excellent |
| 0.010 | 90.5 | 1→0.5 | 0.072 | Excellent |
| 0.010 | 150.0 | 1→0.5 | 0.054 | Excellent |
| 0.018 | 153.0 | 1→0.5 | 0.088 | Excellent |
| 0.044 | 149.0 | 1→0.5 | 0.163 | Good |
| 0.160 | 150.0 | 1→0.5 | 0.203 | Cracked |
| 0.009 | 30.0 | 1.5 | 0.036 | Excellent |
| 0.043 | 91.0 | 1→0.5 | 0.217 | Cracked |
| 0.058 | 150.0 | 1→0.5 | 0.190 | Cracked |
| 0.005 | 45.0 | 1→0.5 | 0.039 | Excellent |
| 0.020 | 60.0 | 1→0.5 | 0.135 | Good |
| 0.019 | 90.0 | 1→0.5 | 0.119 | Good |
| 0.001 | 31.0 | 1→0.5 | 0.009 | Good |
| 0.010 | 31.0 | 1.0 | 0.060 | Excellent |
| 0.010 | 30.0 | 0.5 | 0.139 | Excellent |

EXAMPLE 8

A lead dioxide anode is made using 1/2' diameter graphite rod as substrate as described in Example 1. The plating solution has the following composition.

| | g/l |
|---|---|
| $Pb(NO_3)_2$ | 295 |
| $Cu(NO_3)_2$ | 16.7 |
| $HNO_3$ | 7.0 |
| Bi | 0 |
| Temperature | 79° C |

The anode is plated at an anode current density of 1.0 A/in.$^2$ for 10 minutes followed by plating another 50 minutes at a current density of 0.5 A/in.$^2$. A total of 0.218 Faradays is applied. This anode contains no bismuth and is used as a control to determine its relative performance with bismuth modified lead dioxide anodes given in the following examples 9–13.

EXAMPLE 9

A bismuth modified lead dioxide anode is made as described in Example 1. The preplate is applied from a solution of the following composition.

| | g/l |
|---|---|
| $Pb(NO_3)_2$ | 310 |
| $Cu(NO_3)_2$ | 14.3 |
| $HNO_3$ | 7.5 |
| Bi | 0 |
| Temperature | 78° C |

The applied Faradays are 0.108 at an initial current density of 1 amp/in.$^2$ then decreased to 0.5 A/in.$^2$.

The bismuth modified final plate is applied from a solution of the following composition.

| | g/l |
|---|---|
| $Pb(NO_3)_2$ | 316 |
| $Cu(NO_3)_2$ | 11.6 |
| $HNO_3$ | 30.5 |
| Bi | 1.5 |
| Temperature | 78° C |

The applied Faradays are 0.108 at an anode current density of 1.5 A/in.$^2$.

The plate is hard, dense, fine grained, and strongly adherent to the substrate.

Tests as described in Example 1 are carried out with the improvement shown over the unmodified lead dioxide anode (Example 8).

| Test Temperature ° C | % Improvement in Current Eff. at 5 g NaOCl/l | % Decrease in Voltage | Pb loss Bi-$PbO_2$ Anode / Pb loss $PbO_2$ Anode |
|---|---|---|---|
| 22 | 7.5 | 4.8 | 1/3 |
| 12 | 29.5 | 7.3 | 1/8.3 |
| 5 | 24.0 | 3.0 | 1/2.8 |

EXAMPLE 10

A bismuth modified lead dioxide anode is made as described in Example 1. The preplate is applied from a solution of the following composition.

| | g/l |
|---|---|
| $Pb(NO_3)_2$ | 295 |
| $Cu(NO_3)_2$ | 13.3 |
| $HNO_3$ | 7.7 |
| Bi | 0 |
| Temperature | 78° C |

The applied Faradays are 0.108 at an initial current density of 1 A/in.$^2$ then decreased to 0.5 A/in.$^2$.

The bismuth modified final plate is applied from a solution of the following composition.

| | g/l |
|---|---|
| $Pb(NO_3)_2$ | 310 |
| $Cu(NO_3)_2$ | 11.1 |
| $HNO_3$ | 30.5 |
| Bi | 1.8 |
| Temperature | 78° C |

The applied Faradays are 0.108 at an anode current density of 0.5 A/in.$^2$.

The plate is hard, dense, fine grained and strongly adherent to the substrate.

Tests as described in Example 1 are carried out with the improvement over the unmodified lead dioxide anode (Example 8) shown.

| Test Temperature ° C | % Improvement in Current Eff. at 5 g NaOCl/l | % Decrease in Voltage | Pb loss Bi-$PbO_2$ Anode / Pb loss $PbO_2$ Anode |
|---|---|---|---|
| 22 | 18.9 | 7.3 | <1/62 |
| 12 | 31.4 | 8.6 | <1/164 |
| 5 | 19.7 | 3.0 | <1/400 |

EXAMPLE 11

A bismuth modified lead dioxide anode is made as described in Example 1. The preplate is applied from a solution of the following composition.

| | g/l |
|---|---|
| $Pb(NO_3)_2$ | 293 |
| $Cu(NO_3)_2$ | 13.0 |
| $HNO_3$ | 7.4 |
| Bi | 0 |
| Temperature | 79° C |

The applied Faradays are 0.108 at an initial current density of 1 A/in.$^2$ then decreased to 0.5 A/in.$^2$.

The bismuth modified final plate is applied from a solution of the following composition.

| | g/l |
|---|---|
| $Pb(NO_3)_2$ | 320 |
| $Cu(NO_3)_2$ | 11.2 |
| $HNO_3$ | 91.5 |
| Bi | 1.61 |
| Temperature | 76° C |

The applied Faradays were 0.108 at an anode current density of 1.0 A/in.$^2$.

The plate is hard, dense, fine grained and strongly adherent to the substrate.

Tests as described in Example 1 are applied with the improvement over the unmodified lead dioxide anode (Example 8) shown.

| Test Temperature ° C | % Improvement in Current Eff. at 5 g NaOCl/l | % Decrease in Voltage | Pb loss Bi-$PbO_2$ Anode / Pb loss $PbO_2$ Anode |
|---|---|---|---|
| 22 | 16.0 | 5.4 | <1/62 |
| 12 | 29.5 | 7.8 | <1/164 |
| 5 | 58.8 | 5.9 | <1/400 |

EXAMPLE 12

A bismuth modified lead dioxide anode is made as described in Example 1. The preplate is applied from a solution of the following composition.

| | g/l |
|---|---|
| $Pb(NO_3)_2$ | 304 |
| $Cu(NO_3)_2$ | 13.0 |
| $HNO_3$ | 7.3 |
| Bi | 0 |
| Temperature | 79° C |

The applied Faradays are 0.108 at an initial current density of 1 A/in.$^2$ then decreased to 0.5 A/in.$^2$.

The bismuth modified final plate is applied from a solution of the following composition.

| | g/l |
|---|---|
| $Pb(NO_3)_2$ | 320 |
| $Cu(NO_3)_2$ | 11.2 |
| $HNO_3$ | 90.8 |
| Bi | 1.89 |
| Temperature | 76° C |

The applied Faradays are 0.108 at an anode current density of 0.5 A/in.$^2$.

The plate is hard, dense, fine grained and strongly adherent to the substrate.

Tests as described in Example 1 are carried out with the improvement over the unmodified lead dioxide anode (Example 8) shown.

| Test Temperature ° C | % Improvement in Current Eff. at 5 g NaOCl/l | % Decrease in Voltage | Pb loss Bi-$PbO_2$ Anode / Pb loss $PbO_2$ Anode |
|---|---|---|---|
| 22 | 15.1 | 6.3 | <1/62 |
| 12 | 27.6 | 8.9 | <1/164 |
| 5 | 57.2 | 3.7 | <1/400 |

COMPARISON EXAMPLE 13

A bismuth modified lead dioxide anode is made as described in Example 1. The preplate is applied from a solution of the following composition.

| | g/l |
|---|---|
| $Pb(NO_3)_2$ | 297 |
| $Cu(NO_3)_2$ | 13.0 |
| $HNO_3$ | 7.3 |
| Bi | 0 |
| Temperature | 80° C |

The applied Faradays are 0.108 at an initial current density of 1 A/in.$^2$ then decreased to 0.5 A/in.$^2$.

A bismuth modified final plate is applied from a solution of the following composition wherein the ratio of lead to bismuth is only about 1/.001 and is outside the scope of the present invention.

| | g/l |
|---|---|
| $Pb(NO_3)_2$ | 300 |
| $Cu(NO_3)_2$ | 12.5 |
| $HNO_3$ | 30.0 |
| Bi | 0.182 |
| Temperature | 78° C |

The applied Faradays are 0.108 at an anode current density of 0.7 A/in.$^2$.

Although the plate can be considered to have a good appearance and seems hard and strongly adherent to the substrate, it did not have the same degree of ceramic-like characteristic appearance of the bismuth modified plate as do the previous examples which employ amounts within the scope of the present invention.

Tests as described in Example 1 are carried out with the results when compared to the unmodified lead dioxide anode as shown.

| Test Temperature ° C | % Improvement in Current Eff. at 5 g NaOCl/l | % Decrease in Voltage | Pb loss Bi-$PbO_2$ Anode / Pb loss $PbO_2$ Anode |
|---|---|---|---|
| 22 | No significant difference | 2.5 | 1/1.6 |
| 12 | 11.0 | 5.7 | 1/3.4 |

At 5° C, there is no significant difference in the results observed for the Bi-$PbO_2$ anode as compared to the $PbO_2$ anode. These results illustrate that amounts of bismuth which are less than the amounts set forth herein do not provide the results achievable by the present invention.

The following Table II is presented to illustrate the improved resistance to loss of lead in the coating achieved by following the present invention. It is noted from Table II that the beneficial effect is more pronounced as the temperature of electrolysis decreases. This is particularly important when the anode is operating at low temperatures such as below about 25° C as in cold seawater to produce sodium hypochlorite.

The performance characteristics of the bismuth modified lead dioxide anode of the present invention make it especially attractive for use in cold electrolytes (e.g., about 5 to about 25° C).

Table II

Lead Loss for Lead Dioxide Anodes Containing Varying Amounts of Bismuth Operating at Various Temperatures in Brine Solution to Produce Sodium Hypochlorite Electrolyte: 30 grams NaCl/l — Current Density: 1.2 A/in.$^2$

| Bi/Pb in plate w/w | $HNO_3$ conc. in plating bath during anode preparation, g/l | Lead loss grams/ton of sodium hypochlorite produced at 22° C | 12° C | 5° C |
|---|---|---|---|---|
| 0 | 7.0 | 310 | 820 | 2000 |
| 0 | 90.5 | 240 | 920 | 2400 |
| 0.008 | 30.0 | 210 | 220 | 2300 |
| 0.032 | 30.5 | 97 | 77 | 705 |
| 0.047 | 91.5 | nil* | nil | nil |
| 0.083 | 30.5 | nil | nil | nil |
| 0.16 | 90.8 | nil | nil | nil |

*Nil - below analytically detectable limit.

FIG. 2 and Table III are presented to illustrate the increased current efficiency obtained by following the present invention. In particular, FIG. 2 shows the percent increase in current efficiency in making sodium hypochlorite from 30 g NaCl/l electrolyte over the lead dioxide anode without bismuth with increasing bismuth concentration. The benefit increases as the temperature decreases. For instance, an anode containing 0.08 parts by weight of bismuth to each part of lead in the final plate will produce 32% more hypochlorite (at 5 g NaOCl/l operating at 12° C than a lead dioxide anode without bismuth operating under the same conditions. In addition, Table II illustrates that amounts of Bi much lower (.008) than the amounts set forth herein do not provide improved results as achieved by the present invention, particularly at 5° C.

Moreover, the reduction in lead loss and particularly in cold water electrolysis at temperature of about 5 to about 25° C, by following the present invention, has been visually observed in the tests. The lead from the anode when present in the solution even in concentrations of less than 1 ppm changes the color of the solution from a clear faintly yellow green to a reddish brown color.

Table III

Comparative Current Efficiency Data at 5 g NaOCl/l and 8 g NaOCl/l

| % Bi in Final Plate | % Current Efficiency at 5 g NaOCl/l | | | % Increased C.E. at 5 g NaOCl/l | | | % Current Efficiency at 8 g NaOCl/l | | | % Increased $Cl_4$ at 8 g NaOCl/l | | |
|---|---|---|---|---|---|---|---|---|---|---|---|---|
| | 22° C | 12° C | 5° C | 22° C | 12° C | 5° C | 22° C | 12° C | 5° C | 22° C | 12° C | 5° C |
| 0 | 53 | 52.5 | 44.5 | 0 | 0 | 0 | 34 | 25 | 26.8 | 0 | 0 | 0 |
| 0 | 48.3 | 54 | 40.5 | −8.9 | 2.9 | −9.0 | 31 | 39.8 | 22 | −8.8 | 59 | 18 |
| 0.68 | 52 | 58.3 | 44.5 | −1.9 | 11 | 0 | 37.6 | 44.4 | 31.1 | 11 | 78 | 16 |
| 2.8 | 57 | 68 | 54.2 | 7.5 | 30 | 22 | 40.5 | 56 | 48.6 | 19 | 124 | 81 |
| 4.0 | 61.5 | 68.1 | 69.3 | .16 | 30 | 56 | 45.5 | 58 | 61.9 | 34 | 132 | 131 |
| 7.0 | 63 | 69 | 52.2 | 19 | 31 | 17 | 47.2 | 59.1 | 45.8 | 39 | 136 | 71 |
| 13.7 | 61.5 | 66.8 | 68.7 | 16 | 27 | 54 | 47 | 54.6 | 56.8 | 38 | 118 | 112 |

We have also found that the cell voltage is lower for cells using the bismuth modified lead dioxide anode. The magnitude of this decrease appears to go through a maximum as the temperature decreases. For example, for an anode containing 0.08 parts by weight of bismuth to each part of lead in the final plate in a 30 g NaCl/l brine solution at 22° C and a current density of 1.2 A/in.$^2$ operates at 0.25 volts less than a similarly operating lead dioxide anode. At 12° C the voltage decrease is 0.5 volt and at 5° C the voltage decrease is 0.25 volt. These reductions in voltage are significant inasmuch as they represent a 5% reduction in DC power at 22° C; an 8% reduction at 12° C; and a 5% reduction at 5° C below that required if lead dioxide anodes without bismuth are used at these same temperatures.

FIG. 3 graphically shows the results of plating a large number of lead dioxide anodes on a graphite substrate from plating baths having various bismuth and nitric acid concentrations at 0.5 A/in.$^2$ current density. All anodes prepared in plating baths having the composition to the right and below the lines are good anodes as shown by the plus (+) points showing the Bi/Pb ratio and $HN0_3$ concentration in the plating bath from which the anodes are prepared. Attempts to produce good anodes outside this range failed as indicated by the minus (−) points on the figure.

The region to the left of the limit line represents plating solution composition in which bismuth approaches or exceeds its solubility limit in the plating bath. This is due to the very low solubility of bismuth in neutral or weakly acid solutions. Plating in such conditions give rise to a poorly adhering low density plate.

The region above the nearly horizontal limit line on the curve describes the Bi/Pb ratio and nitric acid composition of the plating bath which promotes excess stress in the plate giving rise to the formation of cracks. The location of this limit line is a function of the current density at which the plate was applied as shown in FIG. 4 and the thickness of the plate. The "limit line" increases as the thickness decreases as discussed hereinabove.

What is claimed is:

1. An anode comprising a substrate having a continuous adherent deposit of lead dioxide containing bismuth in an amount sufficient to provide a ratio of bismuth to lead in the deposit of at least about 1:10$^2$ and being sufficient to increase the current efficiency of the anode at temperature of use below 25° C, and/or to decrease lead loss from the anode surface.

2. The anode of claim 1 wherein the ratio of bismuth to lead in the coating is between about 1:20 and about 1:8.

3. The anode of claim 1 wherein the ratio of bismuth to lead at the surface is greater than the ratio at the substrate interface.

4. The anode of claim 1 which further includes a lead dioxide deposit between said substrate and said deposit of lead dioxide containing bismuth.

5. The anode of claim 1 wherein said substrate is graphite or a metal selected from titanium, tantalum, zirconium, niobium, tungsten, hafnium, mixtures thereof, and alloys thereof.

6. The anode of claim 1 wherein the thickness of the coating is about 0.01' to about 0.5'.

7. The anode of claim 1 wherein the thickness of the coating is about 0.02 to about 0.2.

8. The anode of claim 1 wherein said substrate includes a precoating of an electroreactive metal-containing coating.

9. The anode of claim 8 wherein said metal-containing coating is selected from the group consisting of a metal of the platinum group, oxides thereof, nitrides thereof, borides thereof, and mixtures thereof.

* * * * *